United States Patent [19]

Kobayashi

[11] 4,373,316

[45] Feb. 15, 1983

[54] PLUG DRIVING APPARATUS

[75] Inventor: Takanobu Kobayashi, Katano, Japan

[73] Assignee: Hitachi Shipbuilding & Engineering Company Limited, Osaka, Japan

[21] Appl. No.: 184,530

[22] Filed: Sep. 5, 1980

[51] Int. Cl.[3] ..... B67B 1/04; B65B 7/28

[52] U.S. Cl. ..... 53/67; 53/306; 53/308; 53/319; 53/367

[58] Field of Search ..... 53/67, 68, 76, 319, 53/322, 323, 306, 308, 367

[56] References Cited

U.S. PATENT DOCUMENTS

| | | | |
|---|---|---|---|
| 2,810,249 | 10/1957 | Wysocki | 53/319 X |
| 3,121,984 | 2/1964 | Runco | 53/67 |
| 3,309,838 | 3/1967 | Wilhere | 53/67 |
| 3,453,804 | 7/1969 | Taylor et al. | 53/319 X |
| 3,759,012 | 9/1973 | Pagay | 53/319 X |
| 3,803,800 | 4/1974 | Tavernier | 53/319 X |
| 3,888,065 | 6/1975 | Heisler | 53/319 X |

*Primary Examiner*—Horace M. Culver

*Attorney, Agent, or Firm*—Joseph W. Farley

[57] ABSTRACT

A plug driving apparatus comprising an annular rotary receiver stand for receiving containers, the receiver stand having container placing portions disposed at a plurality of locations thereon in circular arrangement, plug driver heads disposed individually above said placing portions, each of the heads having a sucker portion for sucking and retaining thereon plugs, a plurality of plug pick-up means, each having a retractable hooked portion adapted to be extended to and retracted from a point right beneath the plug driver head, fixed plug-feeder means for feeding plugs to the hooked portion, the plug driver head being adapted to be raised and lowered between an intermediate position where the sucker portion thereof sucks and retains thereon a plug held in the hooked portion and a lower position where plug driving operation is carried out and an upper limit of movement of the driver head. According to the invention, it is possible to manufacture such apparatus of compact construction which permits accurate and highly efficient plug-driving operation.

13 Claims, 17 Drawing Figures

PLUG DRIVING APPARATUS

This invention relates to a plug driving apparatus employed in closing containers such as cans, casks or barrels.

Conventionally, there has been no apparatus capable of driving plugs fed from outside the apparatus into containers with high efficiency as well as with high reliability.

The object of the invention, in view of the above situation, is to provide a compact apparatus for driving plugs with high efficiency and reliability.

To achieve the above object, the invention provides a plug driving apparatus comprising an annular rotary receiver stand for receiving containers, said receiver stand having container placing portions disposed at a plurality of locations thereon in circular arrangement, plug driver heads disposed individually above said placing portions, each of the heads having a sucker portion for sucking and retaining thereon plugs, a plurality of plug pick-up means, each having a retractable hooked portion adapted to be extended to and retracted from a point right beneath said plug driver head, fixed plug-feeder means for feeding plugs to said hooked portion, said plug driver head being adapted to be raised and lowered between an intermediate position where the sucker portion thereof sucks and retains a plug held in the hooked portion and a lower limit where plug driving operation is carried out and an upper limit of movement of the driver head.

According to a preferred embodiment of the present invention, the annular rotary receiver stand is fixedly mounted to a rotary shaft rotatably supported in a fixed box-like frame, and the upward and downward movement of the plug driver heads, plug-sucking action of the sucker portion of each of the plug driver heads, and protraction and retraction of the hooked portion of the plug pick-up means are interconnected through cam means provided around the fixed box-like frame. This assures accurate plug driving operation. Such arrangement also means compactness of the apparatus according to the invention.

In the preferred embodiment of the invention, the plug driver head has a stopper flange adapted to engage a portion of container positioning means for positioning a container exactly in place on the container placing portion. The flange prevents the plug driver head from being lowered past said intermediate position during plug-sucking operation of the head; this assures accurate plug-sucking operation and less complexity of controls.

Furthermore, according to the embodiment of the invention, there is preferably provided, adjacent the front end of the plug feeder means, a plug feed control means for detecting the presence of a container supplied to the container placing portions to control plug supply to the respective hooked portions. With this control means is it possible to ensure accurate detection of the condition of container supply to the container placing portions and controlled supply of plugs in accordance with the condition, so that any possibility of wasteful plug feed and of operational troubles resulting therefrom may be eliminated.

Other objects and advantages of the invention will become apparent from the following description of the preferred embodiment with reference to the accompanying drawings in which.

Figure 13:
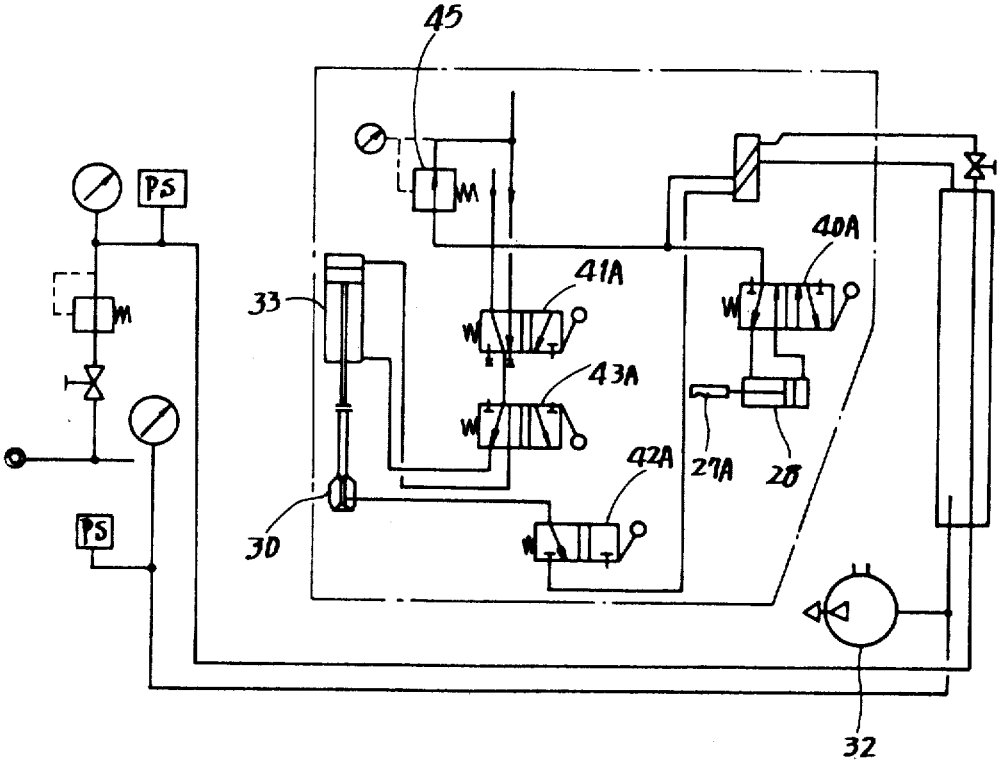
Figure 14:
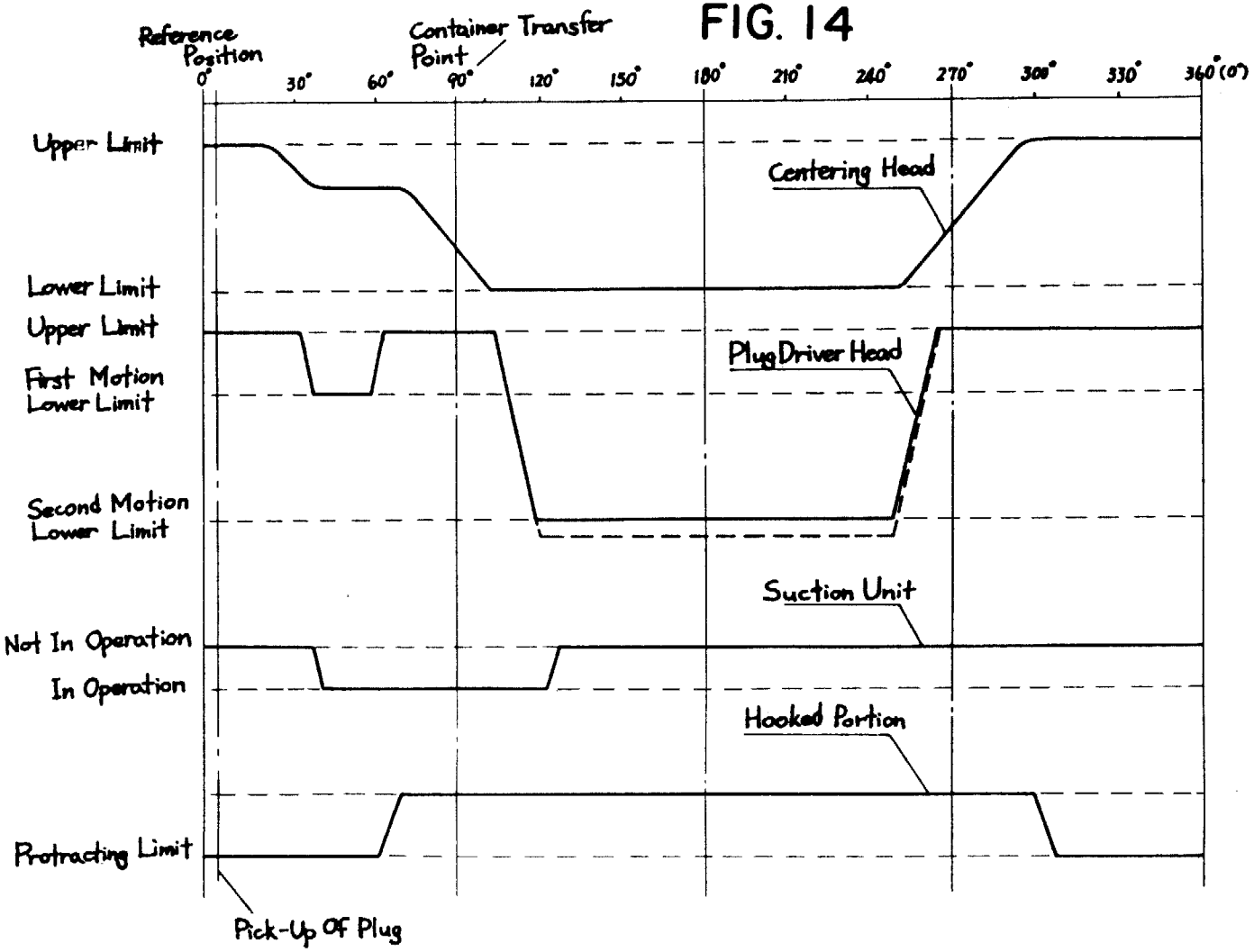

FIGS. 12*a*–12*d* are explanatory views showing a plug driver head at various stages of plug-sucking and plug-driving operation;

FIG. 13 is a diagrammatic illustration showing system of cam means operation; and FIG. 14 is an operational timing diagram.

Figure 1:
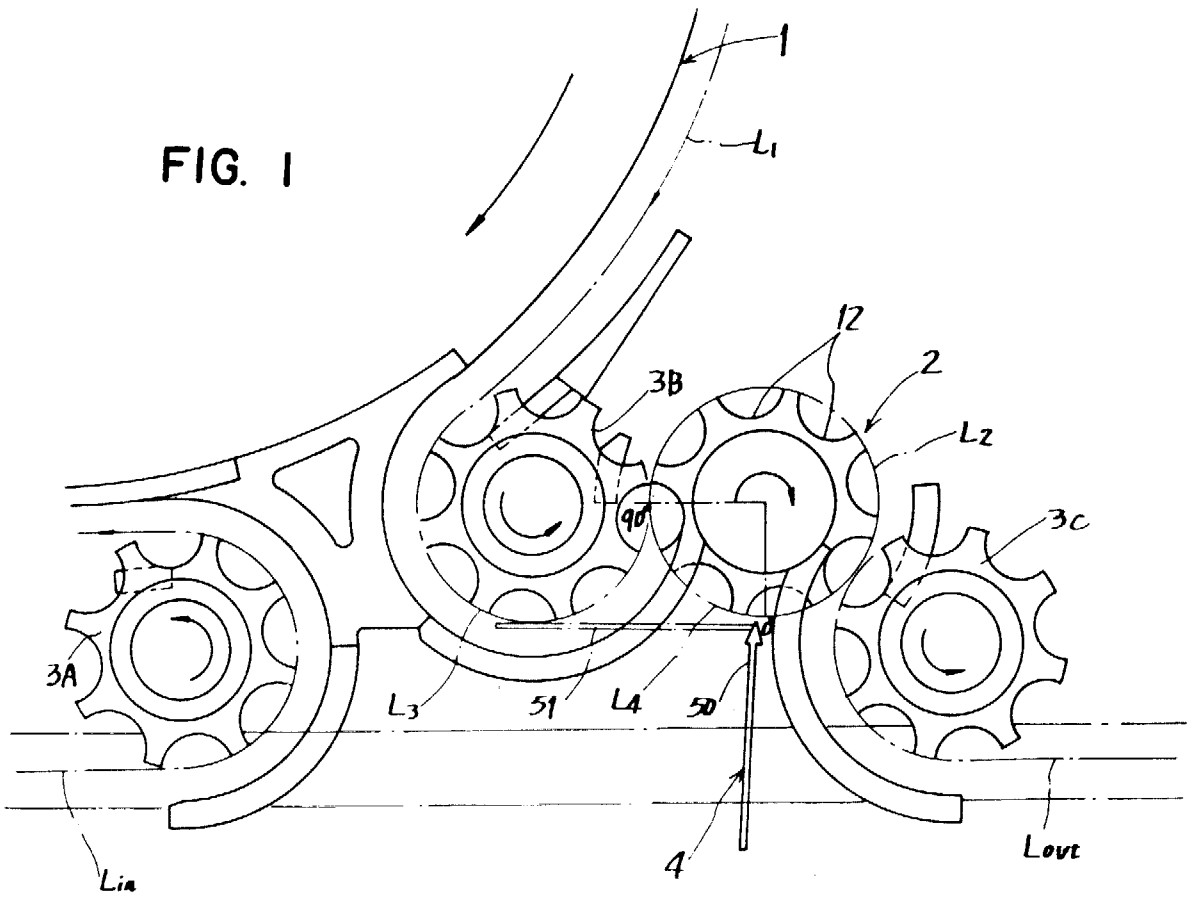
FIG. 1 is a schematic illustration showing the flow of containers and a plug driving apparatus of the present invention.

Referring first to FIG. 1, the numeral 1 designates a fluid charging unit, and the numeral 2 a plug driving unit. Around these are formed a charging path L1 and a plug driving path L2. Containers are charged and plugged during their passage through these paths. The reference characters Lin and Lout designate a container feed-in path and a container take-out path respectively. The feed-in path Lin, charging path L1, plug driving path L2, and take-out path Lout are communicated, one to another, via container aligning and guiding units 3A, 3B and 3C to form a continuous system. At L3 is shown a container aligning and guiding path and at L4 a plug pick-up path. A plug feeder means 4 and a plug feed control means 51 are suitably disposed to face the plug driving unit 2.

Figure 2:
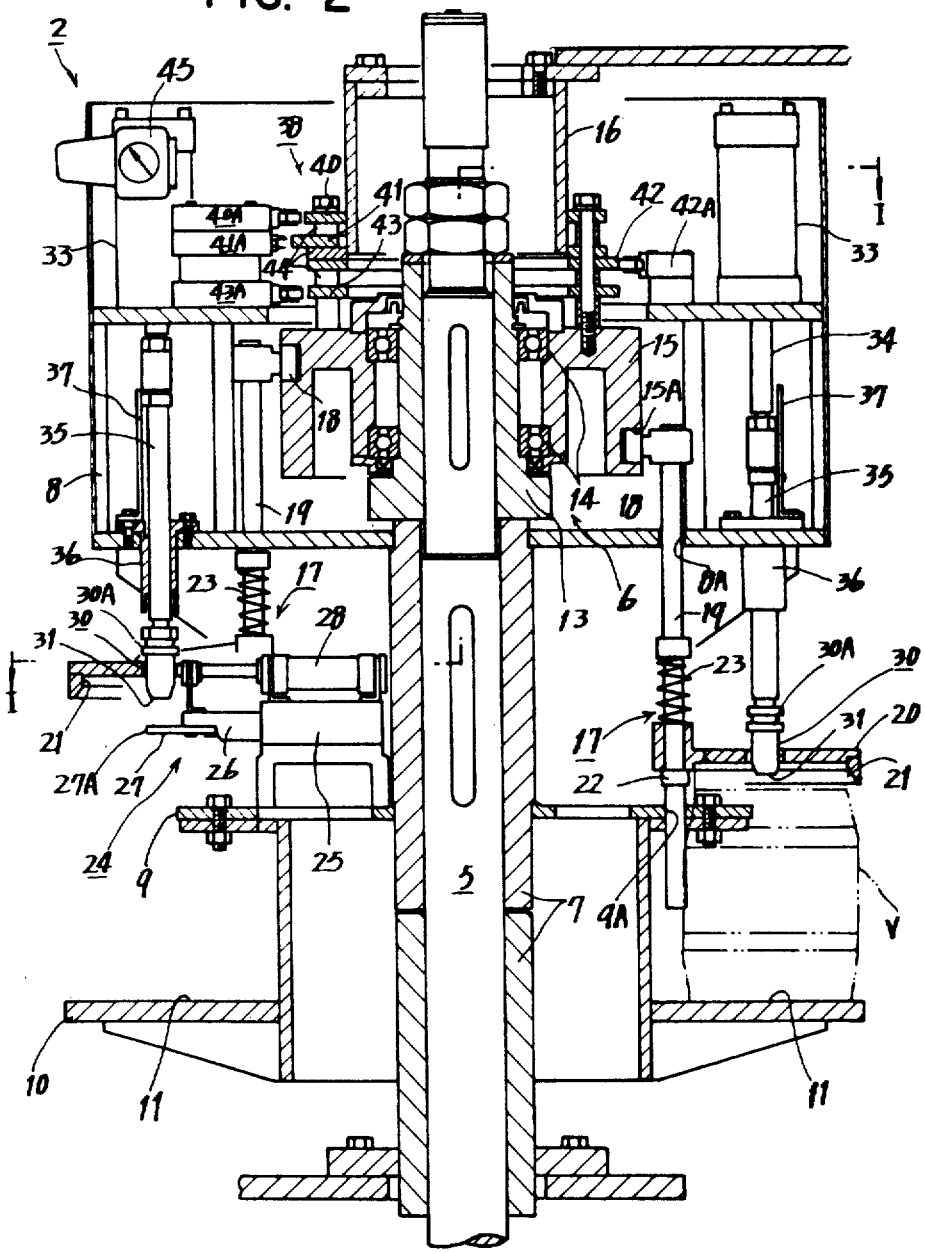
FIG. 2 is a vertical section of a plug driving unit according to a preferred embodiment of the invention.
Figure 3:
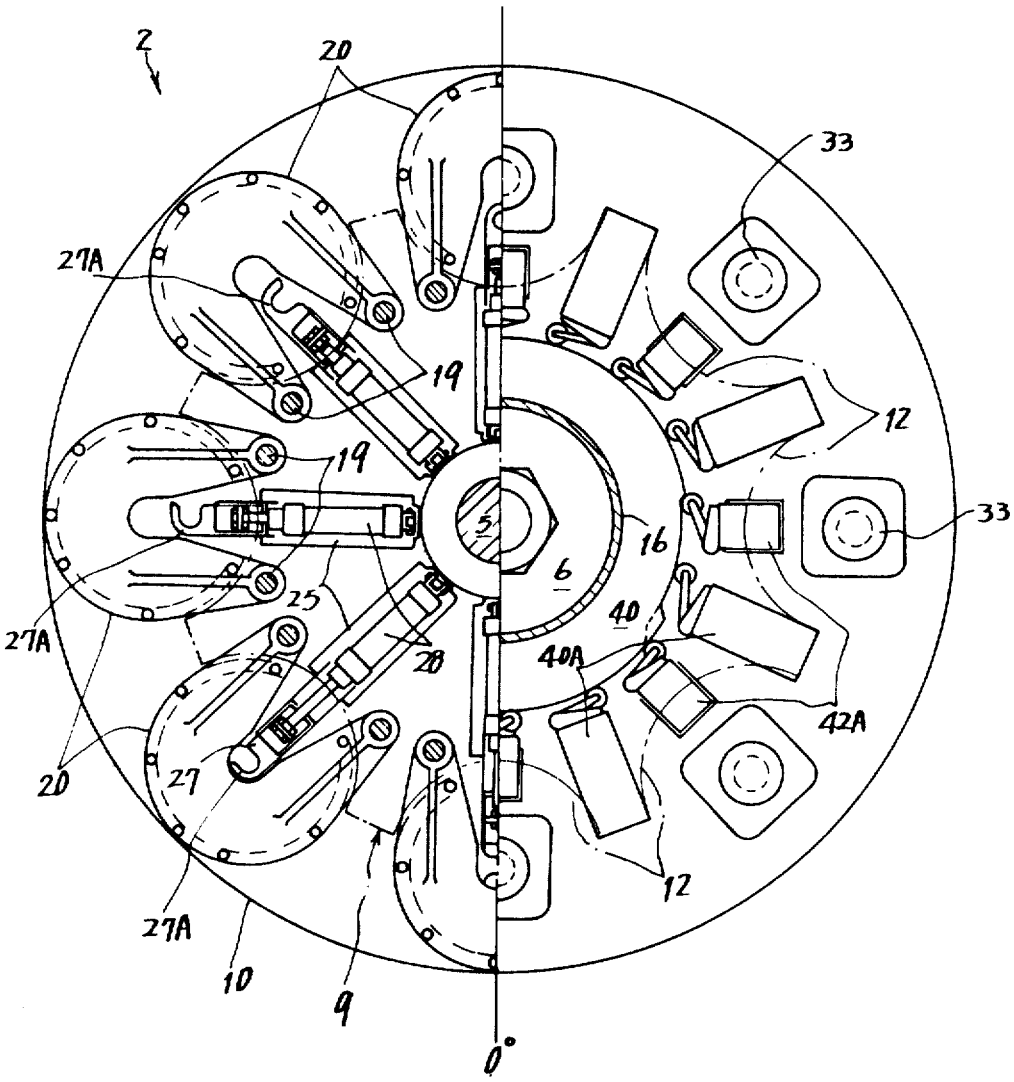
FIG. 3 is a sectional view taken along the line I—I of FIG. 2.

Referring next to FIGS. 2 and 3, the plug driving unit 2 has a rotary shaft 5 supported by an upper support portion 6 and lower support portion (not shown) and adapted to associate with a drive shaft (not shown) of the charging unit 1. Keyed on the rotary shaft 5 are hubs 7 to which an upper mount 8 and a star wheel 9 are fixed. Below the star wheel 9 there is provided an annular container-receiver stand 10 integrally formed therewith. Therefore, the upper mount 8, star wheel 9 and container receiver stand 10 are rotatable integrally with the rotary shaft 5. The receiver stand 10 has a plurality of container placing portions 11 (8 such portions in the embodiment shown) disposed in equiangularly spaced relation to one another in circular arrangement. The star wheel 9, as is apparent from FIGS. 1 and 3, has a plurality (eight) of cutouts 12 on its circumference. The upper support portion 6 comprises a boss 13 keyed on the rotary shaft 5, a cam cylinder 15 fitted around the boss 13 via bearings 14, and a box-like frame 16 fixed to an overall frame. The rotary shaft 5 and the boss 13 fitted securely thereon are rotatably supported through bearings 14 in the cam cylinder 15 which, in turn, is bolted to the fixed frame 16.

The numeral 17 designates positioning means for holding a container V in position on the placing portion 11. The positioning means 17 includes said cam cylinder 15, a roller 18 guided along a cam groove 15A formed on the cam cylinder 15, a pair of guide shafts 19 extending downward from the roller 18, and a centering head 20 mounted to the guide shafts 19. The guide shafts 19 are upwardly and downwardly guided by through-holes 8A, 9A bored in a base plate of the upper mount 8 and the star wheel 9. The centering head 20 has its base portion fitted slidably on the guide shafts 19 and has a holding portion 21 adapted to fit around the outer periphery of the container V to hold the container in position. Designated at numeral 22 is a collar for preventing the centering head 20 from falling; and 23 is a spring provided for keeping the centering head 20 constantly pressed downward. On the star wheel 9 there is provided plug pick-up means 24 which includes a guide 25, a holder secured to the front end of a protract-retract lever 26 guided by the guide 25, and a pneumatic cylinder means 28 for actuating the protract-retract lever 26. The pneumatic cylinder means 28 is shown only as an example of a first operating means; the holder 27 may not necessarily be so adapted as to be retractably movable in a linear direction, but may be moved out of the plug pick-up position by adapting the holder to pivotably move about a vertical axis. As is apparent from FIG. 3, the holder 27 has a hooked portion 27A at the front end thereof. The holder 27 is adapted to pick up a plug 29 fed by the plug feeder means 4 when it turns along with the rotation (clockwise as shown) of the rotary shaft 5 (see FIG. 9).

Shown at 30 is a plug driver head. As can be seen from FIG. 12, the plug driver head 30 is so disposed as to be positioned right above the hooked portion 27A when the latter is protracted. The driver head has a stopper flange 30A engageable with the top of the centering head 20, and in its bottom surface, a concave plug sucker portion 31. The stopper flange 30A is shown only as an example of a member adapted to engage the plug driver head 30 with the centering head 20; it may not necessarily be of the illustrated shape or may be dispensed with. The plug sucker portion 31 is connected to suction means 32 (e.g. vacuum means) (see FIG. 13). The plug driver head 30 is connected, through a connecting rod 35, to a piston rod 34 of a pneumatic cylinder means 33 provided on the upper mount 8. The connecting rod 35 is guided by a guide sleeve 36. A bracket 37 is juxtaposed with the connecting rod 35 to prevent the rod 35 from turning. The pneumatic cylinder means 33 is shown as an example of a second operating means which actuates the plug driver head 30 to perform a two-stage motion as described hereinafter.

The container positioning means 17, plug pick-up means 24, and plug driver head 30 are provided for each container placing portion 11 of the receiver stand 10. These are operated in interlocking relation with one another by cam means 38 including the cam cylinder 15 and roller 18. The cam means 38 are disposed between the rotation side, e.g. the upper mount 8, and the stationary side, e.g. the box-like frame 16. On the stationary side are disposed cam plates of required profiles, while on the rotation side are disposed valves comprising cam rollers and working levers. Among the cam plates are, in descending order, a cam plate 40 for protraction and retraction of the hooked portion 27A, a cam plate 41 for switching the working pressure of the cylinder means 33 between the time of the first stage motion of the plug driver head 30 and the time of the second stage motion of the same, a cam plate 42 for actuating the plug sucker portion 31 of the driver head 30, and a cam plate 43 for lowering the driver head 30 to the plug driving position, with spacers 44 interposed between one cam plate and another. Valves 40A to 43A are disposed in opposed relation to the corresponding cam plates 40 to 43. Shown at 45 is a regulator, which is mounted on the pneumatic cylinder means 33 which moves the plug driver head 30 upward and downward. The regulator 45 functions when the pneumatic cylinder means 33 is in low-pressure operation.

Figure 4:
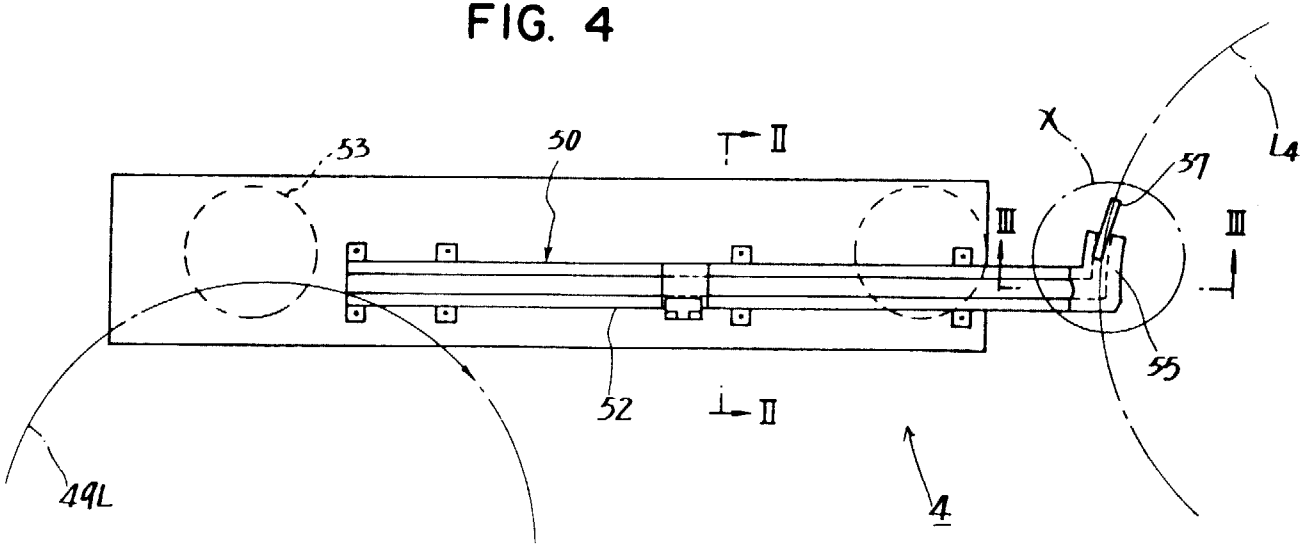
FIG. 4 is a plan view showing a plug aligninging and conveying means.
Figure 5:
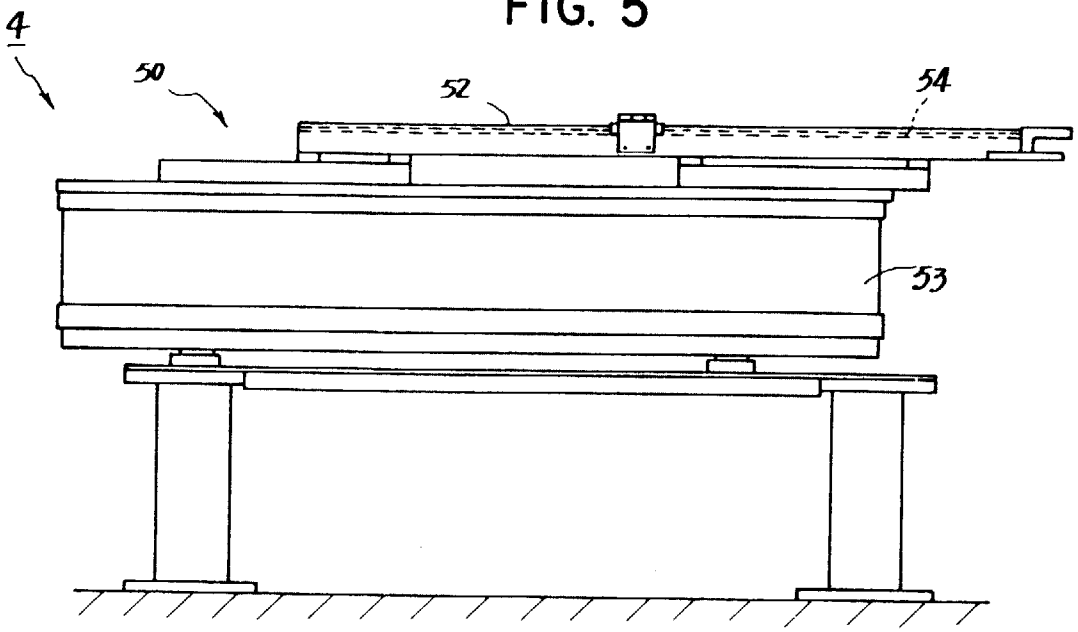
FIG. 5 is a side elevational view thereof.
Figure 6:
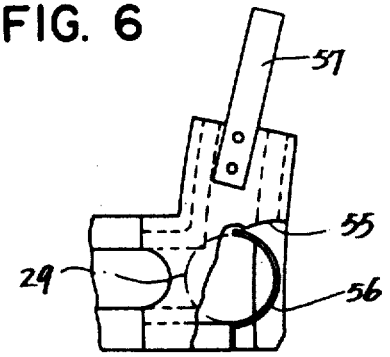
FIG. 6 is an enlarged view of the part X of FIG. 4.
Figure 7:
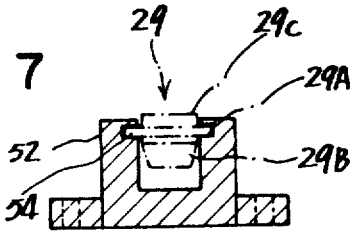
FIG. 7 is a sectional view taken on the line II—II of FIG. 4.
Figure 8:
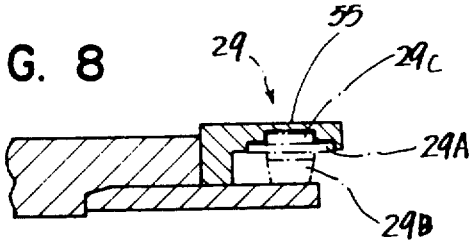
FIG. 8 is a sectional view taken on the line III—III in FIG. 4.
Figure 11:
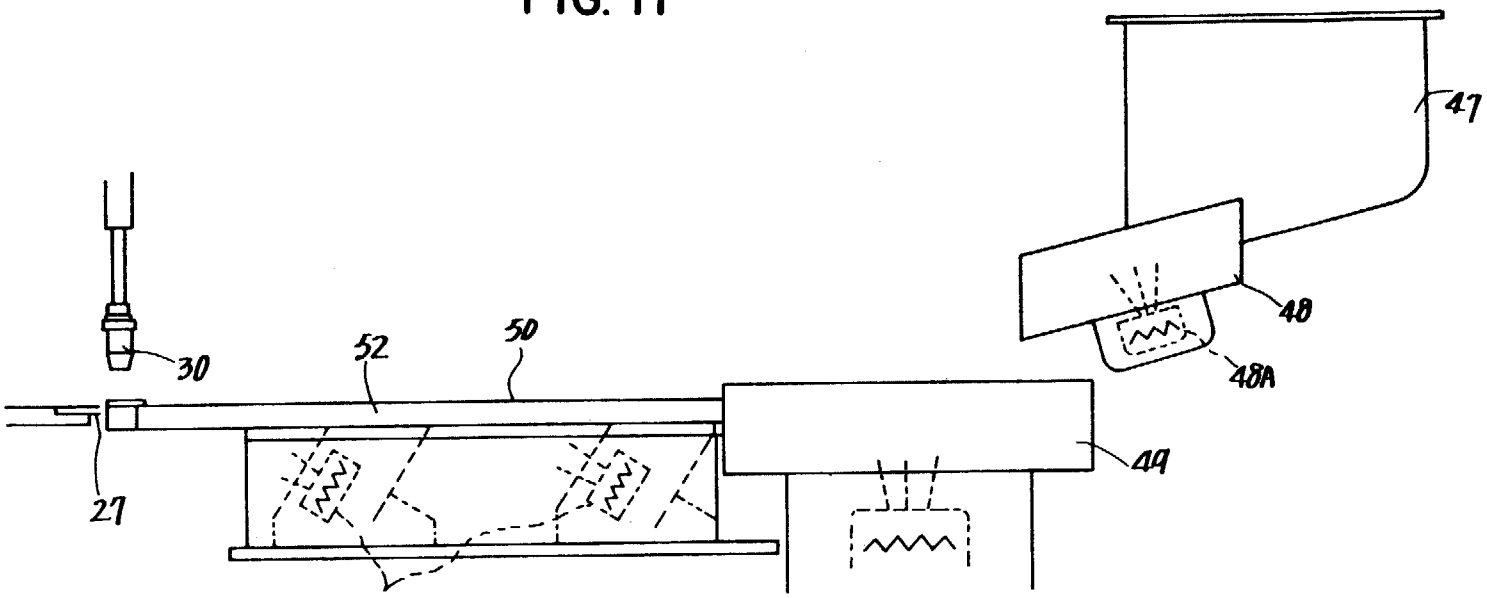
FIG. 11 is a side view showing a plug feeder means.

Plugs 29 of specified shape are steadily supplied from the plug feeder means 4 to the plug driving unit 2 in aligned condition. As FIGS. 7, 8 and 12 indicate, the plugs 29 have, below and above a collar 29A respectively, an insert portion 29B for insertion into an opening provided in the top of the container and an upwardly projecting portion 29C. The plug feeder means 4, as can be clearly seen from FIGS. 4 to 8 and 11, comprises a hopper 47, delivery means 48, aligning means 49, and aligning and conveying means 50. The delivery means 48 is adapted to automatically deliver to the aligning means 49 plugs 29 in appropriate quantities from the stock of plugs randomly stored in the hopper 47 by the vibrating action of a vibrator 48A. In the aligning means 49, the plugs 29 are moved by vibration in the circumferential direction and aligned in the course of their movement. Then, the plugs 29 are conveyed in aligned condition in the tangential direction of the movement path 49L (see FIG. 4) in the aligning means 49 to the aligning and conveying means 50. The aligning and conveying means 50 has a chute 52. As illustrated in FIGS. 5 and 11, the chute 52 has, in the lower portion thereof, a rectilinear feeder 53 designed so that plugs 29 can be conveyed by vibration to the forward end of the chute 52. On both side walls of the passage for plugs in the chute 52 there are formed grooved rails 54 for guiding the collar portion 29A of the plug 29. The front end portion of the chute 52 is bent along the turning path (plug pick-up path L4) of the hooked portion 27A and is provided with a ceiling plate 55. At the bent corner of the chute 52 there is provided a spring 56 of crooked shape to receive the forefront one of the plugs 29 delivered in aligned condition. A leaf spring 57 is attached to the ceiling plate 55 as an extension thereto.

The plug feed control means 51 is disposed adjacent the plug feeder means 4 and the container aligning and guiding unit 3B over a distance extending therebetween (see FIG. 1). As can be clearly seen from FIGS. 9 and 10, a detecting lever 60 is disposed on the unit 3B side, while on the plug feeder means 4 side there is disposed a plug-pressing arm 61 having a plug-pressing seat 61A. The detecting lever 60 is so disposed as to face the path L3 of the container aligning and guiding unit 3B and is connected through a vertical shaft 62 to a rocking arm 63 pivotable about the shaft 62. The lever 60 is pivotably movable about the vertical shaft 62. The plug-pressing arm 61 is connected to a vertical lever 65 through a horizontal shaft 64. Numeral 66 designates a retractable rod which is connected through a coupling 67 to a connecting rod 68 extending from the rocking arm 63 and which passes through the lower end of the vertical lever 65. The retractable rod 66 and connecting rod 68 constitute a transmission shaft. The vertical lever 65 is grasped between a stopper 69 and a spring seat 70, both provided on the retractable rod 66. At 71 is disposed a spring urging the spring seat 70, and at 72 a spring urging the plug-pressing seat 61A downward. The spring 72 is positioned between a stopper 74 provided on the connecting rod 68 and a base 73 for the vertical shaft 62. The plug-pressing seat 61A is located immediately above a plug 29b next to a forefront plug 29a at the forward end portion of the chute 52. The detecting lever 60, in turn, is disposed at a location which enables the lever 60 to detect the presence of a container V to be fed to the container placing portion 11 where the plug 29b is driven.

The manner of operation of the above described apparatus will be explained particularly with reference to FIGS. 12 and 14. The plug driving unit 2 has its frontal position set as reference position (angle of turn 0°) (See FIG. 1). When the unit 2 turns clockwise 90° from the reference position, a container V is transferred completely from the container aligning and guiding unit 3B on to the container placing portion 11 of the receiver stand 10. Therefore, the lever 60 of the container feed control means 51 must be disposed at a position 90° away clockwise from the container transfer point along the container aligning and guiding path $L_3$. A plug 29 is fed onto the plug pick-up path L4 at a position 5° away from the reference position (see FIG. 9).

Figures 12A, 12B, 12C, 12D:
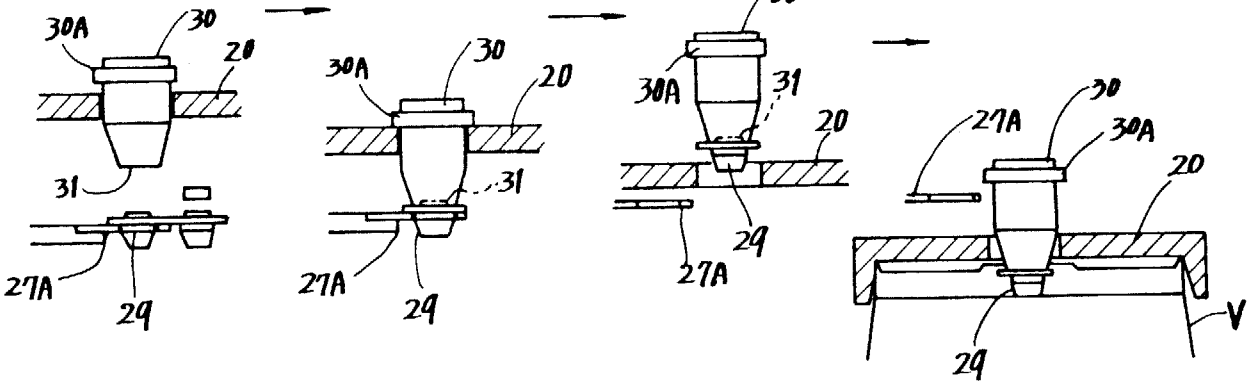

As the rotary shaft 5 rotates in interlocked relation with the charging unit 1, the container receiver stand 10, container positioning means 17, plug pick-up means 24, and plug driver head 30 rotate integrally therewith. At the reference position, the centering head 20 and plug driver head 30 are at their upper limits of movement (upper stand-by position), while the hooked portion 27A is at its fully protracted position. When the hooked portion 27A turns 5°, it begins to pick up the forefront plug 29 held by the crooked spring 56 at the front end portion of the chute 52; and the pick-up operation is completed when the turn exceeds 5° (see FIG. 12a). With further turn of the hooked portion 27A, the plug 29 is forcibly drawn from the spring 56 and brought on to the plug pick-up path L4 from the bent portion of the chute 52 while being held in the hooked portion 27A, whereupon the leaf spring 57 comes in resilient contact with the top of the plug 29 so that the plug 29 is further securely held in the hooked portion 27A. When the angle of turn reaches about 25°, the centering head 20 begins to move downward; and after the transfer of the container V onto the container placing portion 11 of the container receiver stand 10 is completed as above described, the centering head 20 reaches its lower limit of movement at 103° to position the container V. At this time, the centering head 20 presses the container V resiliently because of the urging force of the spring 23. Meanwhile, at 35°, the plug driver head 30 starts its first-stage downward movement, and when the limit of such movement (intermediate position) is reached, the plug sucker portion 31 of the driver head 30 is caused to fit over the projecting portion 29C of the plug 29 retained in the hooked portion 27A (see FIG. 12b). At this time, the stopper flange 30A of the plug driver head 30 engages the top of the centering head 20, whereby the driver head 30 is prevented from descending beyond the immediate position. The pneumatic cylinder means 33 is in the condition of low pressure operation at this time. Immediately thereafter the valve 42A is switched to start suction and the plug 29 is drawn to the plug driver head 30. The suction is continued until a moment after the start of plug driving operation (turn angle 130°). When a turn angle of 60° is reached, the plug driver head begins to move upward while holding the plug 29; with a little further turn (at 64°), the hooked portion 27A is retracted from its position right below the driver head 30 toward the rotary shaft 5 (see FIG. 12C). Immediately after the container V is positioned by the centering head 20, the driver head 30 starts a second-stage downward movement, and plug driving operation is completed until 250° (FIG. 12d). Until the completion of the plug driving operation the driver head 30 remains at its second motion lower limit. After completion of the plug driving operation, the driving head 30 is moved upward to its upper standby position, where it stands by until the start of next plug sucking operation. Following the upward movement of the plug driver head 30, the centering head 20 is moved to its upper position, whereupon the container is released from the positioning operation. Immediately thereafter, the container V is transferred on to the take-out path Lout for delivery. One cycle of operation is thus completed, and same operation is repeated for subsequent cycles.

Figure 9:
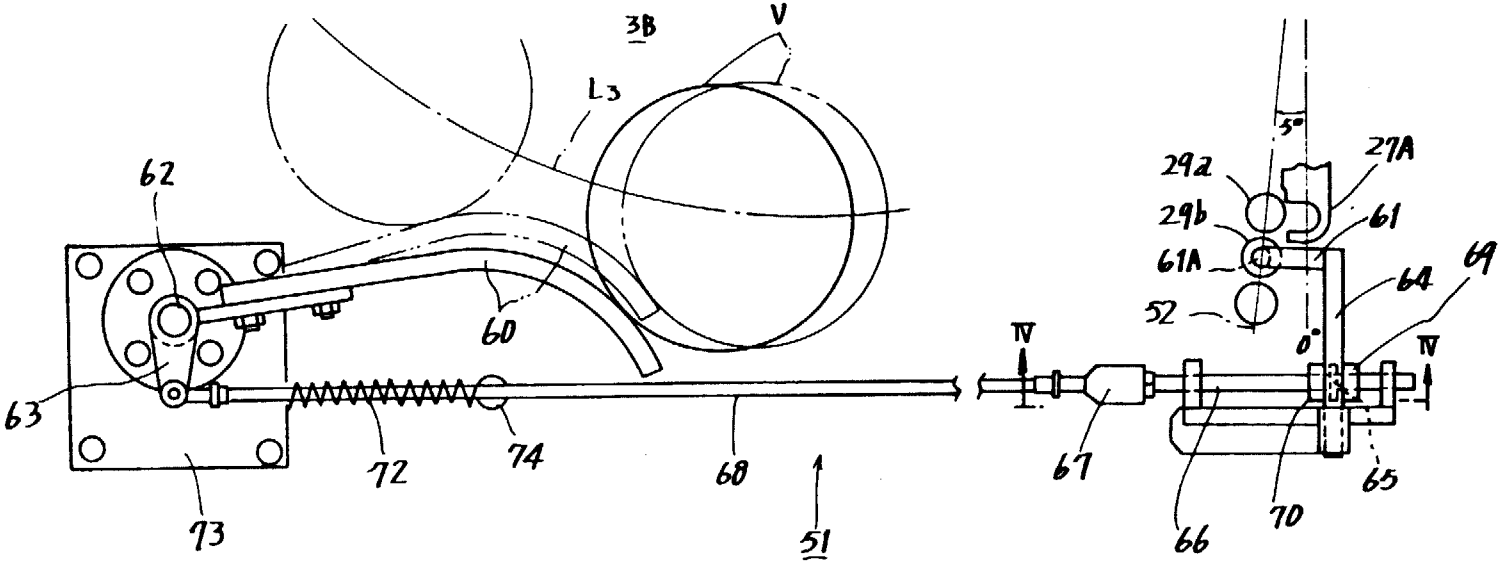
FIG. 9 is a plan view of a plug feed control means.
Figure 10:
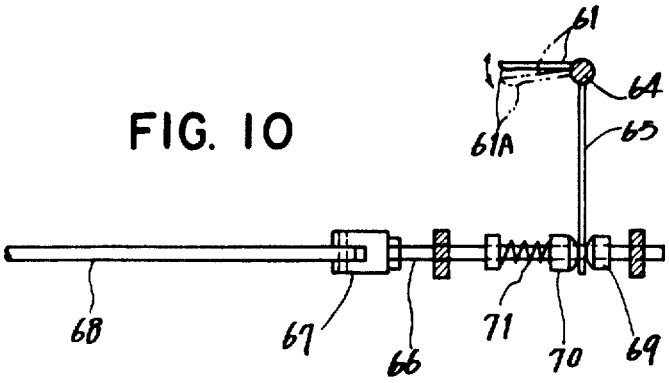
FIG. 10 is a sectional view taken along the line IV—IV of FIG. 9.

In the above described operation, if there is the absence of a container V on the container aligning and guiding unit 3B, the detecting lever 60 of the plug feed control means 51 detects the absence (see the phantom line in FIG. 9). Thereupon, the second plug 29b is pressed against the chute 52 by the plug pressing seat 61 of the plug pressing arm 61 through downward pivotal movement of the pressing arm 61 about the horizontal shaft 64, whereby the feed of the plug 29b is suspended. The suspension of the feed is removed later when the detecting lever 60 detects the presence of a container V. Thanks to such control means, wasteful feed of plug 29 may be avoided.

What is claimed is:

1. A plug driving apparatus comprising:

a vertical shaft;

an annular rotary receiver stand mounted on said shaft and having a plurality of container placing portions in a circular arrangement;

a plurality of plug driver heads each disposed above one of the container placing portions and having an end portion for retaining a plug, each driver head being vertically movable by first cylinder means between an upper stand-by position, an intermediate plug receiving position and a lower plug driving position;

plug pick-up means provided at each container placing portion, each plug pick-up means being linearly extendable and retractable by second cylinder means to and from a position right beneath a corresponding driver head;

fixed plug feeder means for successively feeding plugs to said plug pick-up means;

container positioning means provided at each container placing portion and comprising a downwardly and upwardly movable centering head having at the outer periphery thereof a holding portion adapted to fit, from above, around the outer periphery of the top portion of a container, the centering head having a hole in the central portion thereof for allowing the passage therethrough of a corresponding driver head; and cam means disposed around the vertical shaft, said cam means comprising a first cam track for controlling the vertical movement of each driver head by the first cylinder means, a second cam track for switching the working pressure of the first cylinder means between low pressure operation to the intermediate plug receiving portion and high pressure operation to the lower plug driving position, a third cam track for extending and retracting the individual plug pick-up means by the second cylinder means, and a fourth cam track for vertically moving the centering heads of the positioning means.

2. A plug driving apparatus as defined in claim 1 wherein the end portion of each plug driver head is adapted to retain a plug by suction, and said cam means comprises a fifth cam track for controlling the suction in the end portions of the plug driver heads.

3. A plug driving apparatus as defined in claim 1 wherein each plug driver head has a stopper flange engageable with the corresponding centering head adjacent the hole in the central portion thereof.

4. A plug driving apparatus as defined in claim 3 wherein said fourth cam track is adapted to move the centering heads to an intermediate position corresponding to the intermediate plug receiving position of the plug driver heads, the plug receiving position of each plug driver head being defined by the engagement between its stopper flange and the corresponding centering head.

5. A plug driving apparatus as defined in claim 1 or 2 wherein the vertical shaft is rotatably mounted in a fixed frame, the annular receiver stand is secured to the vertical shaft, and the cam means are disposed on the fixed frame.

6. A plug driving apparatus as defined in claim 1 or 2 wherein the plug pick-up means in the extended position thereof is adapted to pick up a plug from the fixed plug feeder means.

7. A plug driving apparatus as defined in claim 1 wherein the cam means is adapted to define an operating cycle during one revolution of the receiver stand whereby:

a. the pick-up means in the extended position thereof picks up a plug from the plug feeder means;
b. the centering head is moved from an upper position downwardly by the fourth cam track to an intermediate position corresponding to the plug receiving position of the driver head;
c. the plug driver head is moved under the control of the first and second cam tracks by the first cylinder means at low working pressure from the upper standby position to the intermediate plug receiving position, thereby receiving a plug from the pick-up means, and is returned to the upper standby position;
d. the pick-up means is moved under the control of the third cam track by the second cylinder means to a retracted position;
e. the centering head is moved downwardly by the fourth cam track into engagement with a container;
f. the plug driver head is moved under the control of the first and second cam tracks by the first cylinder means at high working pressure from the upper standby position to the lower plug driving position;
g. the centering head is returned to the upper position by the fourth cam track and the plug driver head is returned to the upper stand-by position by the first cylinder means under the control of the first and second cam tracks; and,
h. the pick-up means is returned to the extended position by the second cylinder means under the control of the third cam track.

8. A plug driving apparatus as defined in claim 7 wherein the end portion of each plug driver head is adapted to retain a plug by suction and said cam means comprises a fifth cam track adapted to control the application of suction to the end portion when the plug driver head reaches the intermediate plug receiving position and until the plug driver head subsequently reaches the lower plug driving position.

9. A plug driving apparatus according to claims 7 or 8 wherein the centering head in the intermediate position thereof is engageable by the plug driver head to define the plug receiving position of the plug driver head.

10. A plug driving apparatus as defined in claim 1, wherein there is provided, adjacent the front end of said plug feeder means, a plug feed control means for detecting the presence of containers supplied respectively to said container placing portions to control plug supply to the corresponding pick-up means.

11. A plug driving apparatus as defined in claim 10, wherein said plug feed control means includes a detecting lever adapted to pivotably move about its base portion in accordance with the condition of container supply to said container placing portions, means for converting the movement of said detecting means into rotation of a horizontal shaft, a plug pressing arm connected to said horizontal shaft and adapted to pivotably move with said horizontal shaft, a plug subject to control being pressed at the lower limit of the movement of said plug pressing arm to halt plug feed.

12. A plug driving apparatus as defined in claim 1, wherein said plug feeder means comprises a hopper for randomly storing plugs, delivery means for delivering an appropriate quantity of the plugs out of the stock kept in said hopper, aligning means for aligning the delivered plugs, and aligning and conveying means for receiving the aligned plugs and conveying the plugs in aligned condition to said pick-up means.

13. A plug driving apparatus as defined in claim 12, wherein said aligning and conveying means comprises a chute forming a passageway for the plugs and having at the forward end portion thereof a bent portion, transfer means for moving the plugs along said chute, and a crooked spring provided at the corner of said bent portion and adapted to receive the first one of the plugs conveyed in aligned condition.

* * * * *